US005988803A

United States Patent [19]

Komplin et al.

[11] Patent Number: 5,988,803

[45] Date of Patent: Nov. 23, 1999

[54] INK LEAKAGE CONTROL ARRANGEMENT FOR AN INK CARTRIDGE

[75] Inventors: Steven Robert Komplin; James Harold Powers, both of Lexington, Ky.

[73] Assignee: Lexmark International, Inc., Lexington, Ky.

[21] Appl. No.: 08/990,116

[22] Filed: Dec. 12, 1997

[51] Int. Cl.[6] ..... B41J 2/175

[52] U.S. Cl. ..... 347/86

[58] Field of Search ..... 347/7, 84, 85, 347/86, 87; 222/1, 212, 206

[56] References Cited

U.S. PATENT DOCUMENTS

| | | | |
|---|---|---|---|
| 5,409,134 | 4/1995 | Cowger et al. | 347/87 |
| 5,526,030 | 6/1996 | Baldwin et al. | 347/87 |
| 5,537,134 | 7/1996 | Baldwin et al. | 347/85 |
| 5,600,358 | 2/1997 | Baldwin et al. | 347/87 |

*Primary Examiner*—N. Le
*Assistant Examiner*—Anh T. N. Vo
*Attorney, Agent, or Firm*—John J. McArdle

[57] ABSTRACT

A sealed reservoir of an ink cartridge of an ink jet printer has one or two spring-loaded bags therein functioning as an accumulator to control back pressure within the sealed reservoir. A source of ambient air for the bag or bags also serves as a source of the air for an air bubble generator. The interior of the single bag or one of the two bags communicates with the air bubble generator so that air is supplied to the air bubble generator when air bubbles are required within the sealed reservoir to decrease back pressure therein. This same air flow arrangement from the interior of the single bag or one of the two bags permits the interior of the bag to receive ink leaking from the sealed reservoir passing through at least one capillary channel of the air bubble generator when the back pressure within the sealed reservoir becomes too low.

21 Claims, 8 Drawing Sheets

INK LEAKAGE CONTROL ARRANGEMENT FOR AN INK CARTRIDGE

FIELD OF THE INVENTION

This invention relates to an arrangement for preventing leakage of ink from an ink cartridge of an ink jet printer and, more particularly, to an arrangement for controlling the flow path of ink leaking from a sealed reservoir of an ink cartridge of an ink jet printer.

BACKGROUND OF THE INVENTION

U.S. Pat. No. 5,409,134 to Cowger et al discloses an ink cartridge for an ink jet printer in which the back pressure within a sealed reservoir of the ink cartridge is regulated through an accumulator comprising a flexible bag mounted to a curved spring.

U.S. Pat. No. 5,526,030 to Baldwin et al has an air bubble generator for supplying air bubbles to a sealed reservoir to reduce its back pressure and a labyrinth for storing a predetermined volume of ink when the ink leaks through the air bubble generator.

U.S. Pat. No. 5,600,358 to Baldwin et al uses a hydrophobic membrane to prevent the flow of ink through an air vent opening connected to the labyrinth. Thus, the aforesaid Baldwin et al Patent, 5,600,358, recognizes the problem of ink leaking from the ink cartridge of the aforesaid Cowger et al patent. However, the aforesaid Baldwin et al patent, 5,600,358, requires the labyrinth and a second vent opening, which is connected to the labyrinth, adjacent the lowermost portion of the ink cartridge.

SUMMARY OF THE INVENTION

The ink leakage control arrangement of the present invention satisfactorily overcomes the problems of the aforesaid Cowger et al and Baldwin et al patents in that the ink leakage control arrangement does not require a second vent opening adjacent the lowermost portion of the ink cartridge. Thus, no easy flow of the ink to the ambient atmosphere can occur as in the aforesaid Baldwin et al patent, 5,600,358.

While the ink leakage control arrangement of the present invention utilizes an air bubble generator in an ink cartridge of an ink jet printer, the ink leaking past a plurality of fixed size capillary channels of the air bubble generator is directed to the interior of a flexible bag or bags forming an accumulator of the ink cartridge. The accumulator balances the back pressure through the flexure of its spring.

Accordingly, the ink leakage control arrangement of the present invention eliminates the problem of leakage of ink from the ink cartridges of the aforesaid Cowger et al and Baldwin et al patents.

An object of this invention is to provide a disposable ink cartridge for an ink jet printer in which leakage of ink from the ink cartridge is prevented.

Another object of this invention is to provide an ink cartridge having an arrangement for preventing leakage from the ink cartridge without impairing its function and operation.

A further object of this invention is to provide an arrangement in which a sealed reservoir of the ink cartridge has its back pressure maintained within an operating range through utilization of a single vent for communication from the ambient atmosphere to the interior of the ink cartridge.

Still another object of this invention is to provide an arrangement for an ink cartridge in which leakage of ink from the ink cartridge is prevented and in which parts are easy and inexpensive to manufacture and has few complicated parts.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
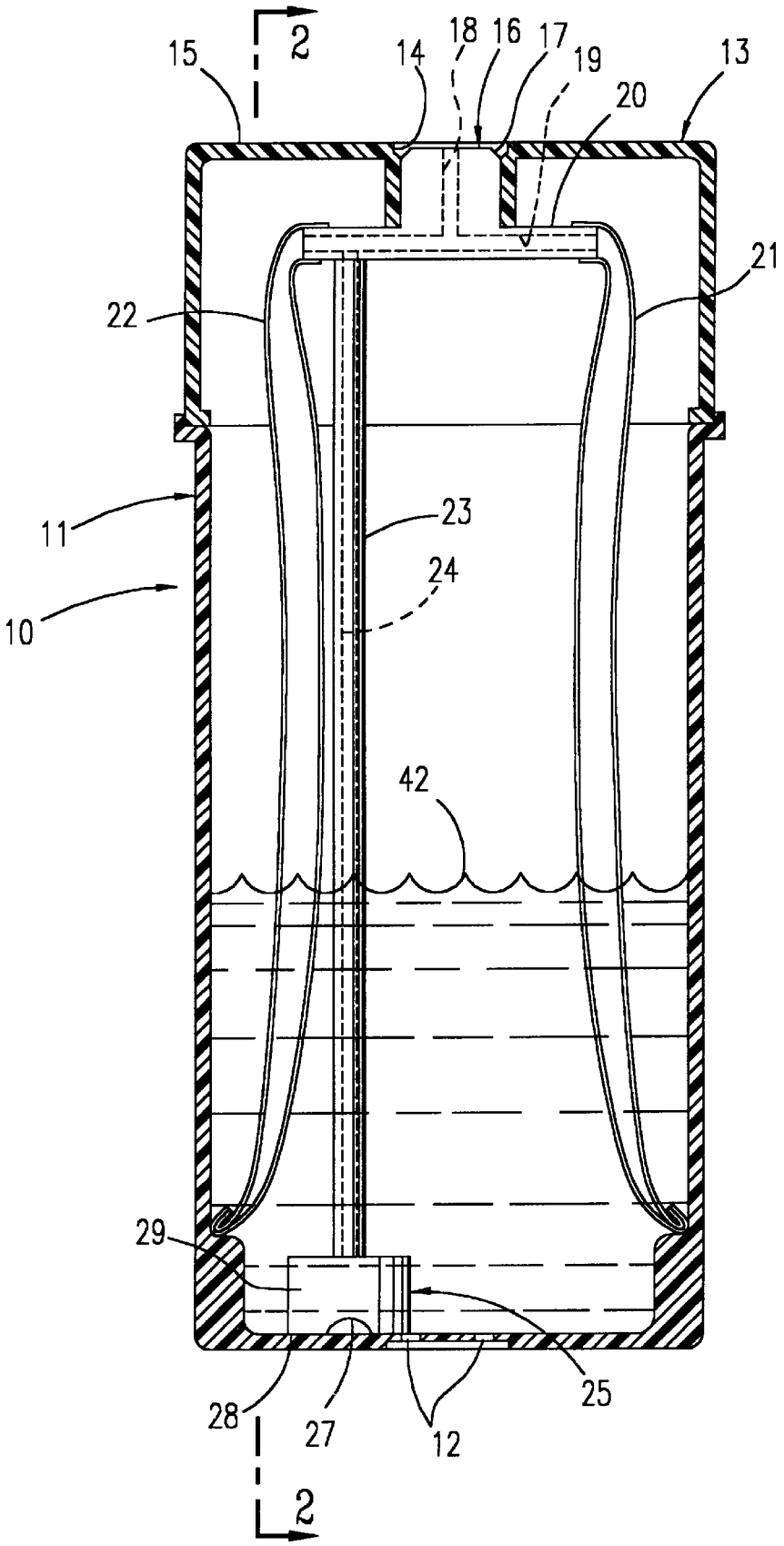
FIG. 1 is a front cross-sectional view, partly in elevation, of an ink cartridge having an ink leakage control arrangement of the present invention.

Referring to FIG. 1, there is shown an ink cartridge 10 for use with an ink jet printer. The ink cartridge 10 includes a sealed reservoir 11 communicating with a print head 12.

A cap 13 of the ink cartridge 10 has an opening 14 in its upper surface 15 within which is supported an inlet vent 16, which is formed of a suitable plastic. The inlet vent 16 includes a vent portion 17 having a vertical passage 18 extending therethrough and communicating with a horizonal passage 19 in a horizonal bag support portion 20 of the vent 16.

The horizonal bag support portion 20 has bags 21 and 22 mounted on opposite ends thereof. The bags 21 and 22 communicate through the horizonal passage 19 in the horizonal bag support portion 20 and the vertical passage 18 in the vent portion 17 to the ambient atmosphere exterior of the sealed reservoir 11.

The horizonal bag support portion 20 of the inlet vent 16 has a vertical surge tube 23 extending downwardly therefrom. The vertical surge tube 23 has a vertical passage 24 communicating with the horizonal passage 19 in the horizonal bag support portion 20. Accordingly, the vertical passage 24 not only communicates with the ambient air through the horizonal passage 19 and the vertical passage 18 in the vent portion 17 but also with the interior of each of the bags 21 and 22.

The lower end of the vertical surge tube 23 has a housing 25 integrally molded therewith. The housing 25 has a plurality of horizontal scallops or grooves 27 (see FIG. 3) in its bottom surface 28 extending from its outer wall 29 to an inner wall 30 of a cylindrical recess 31.

The cylindrical recess 31 in the housing 25 communicates with the lower end of a vertical passage 32. The vertical passage 32 has its upper end communicating with the lower end of the vertical passage 24 in the vertical surge tube 23.

The inner wall 30 of the cylindrical recess 31 is defined by a plurality of equiangularly spaced ribs 33. Vertical spaces or grooves 34 in the inner wall 30 of the cylindrical recess 31 between the ribs 33 communicate at their lower ends with the horizontal scallops or grooves 27 in the bottom surface 28 of the housing 25.

The upper ends of the vertical spaces or grooves 34 in the inner wall 30 of the cylindrical recess 31 communicate with horizontal grooves 35 in an upper wall 36 of the cylindrical recess 31. The horizontal grooves 35 communicate with the vertical passage 32 in the housing 25.

Figure 3:
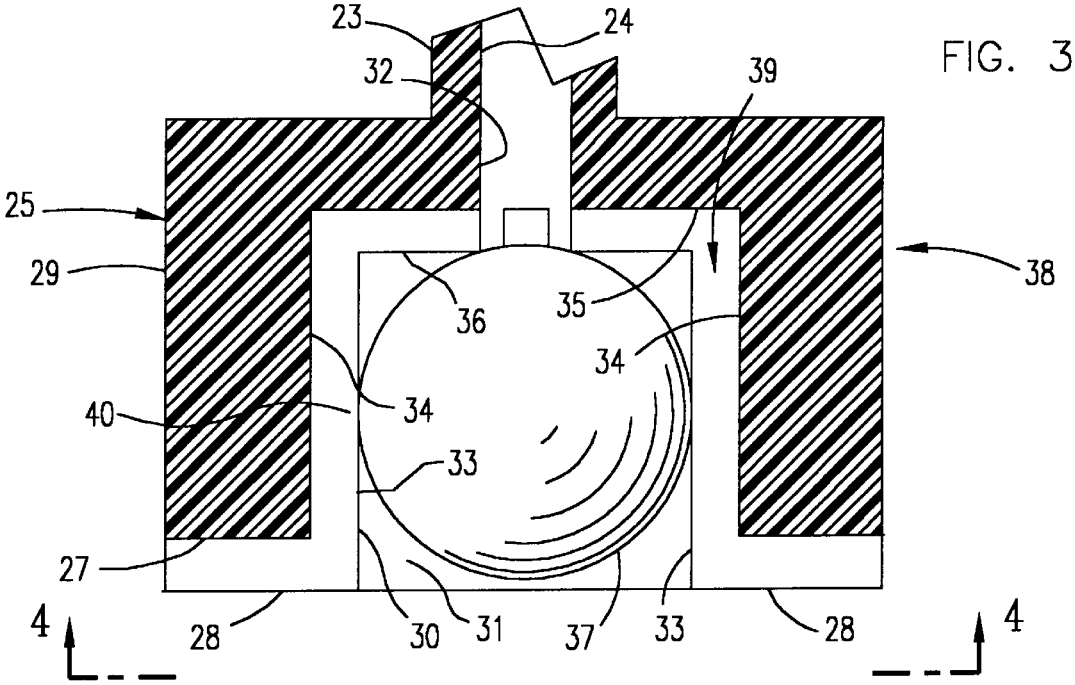
FIG. 3 is a cross-sectional view of a preferred embodiment of an air bubble generator of the present invention.
Figure 4:
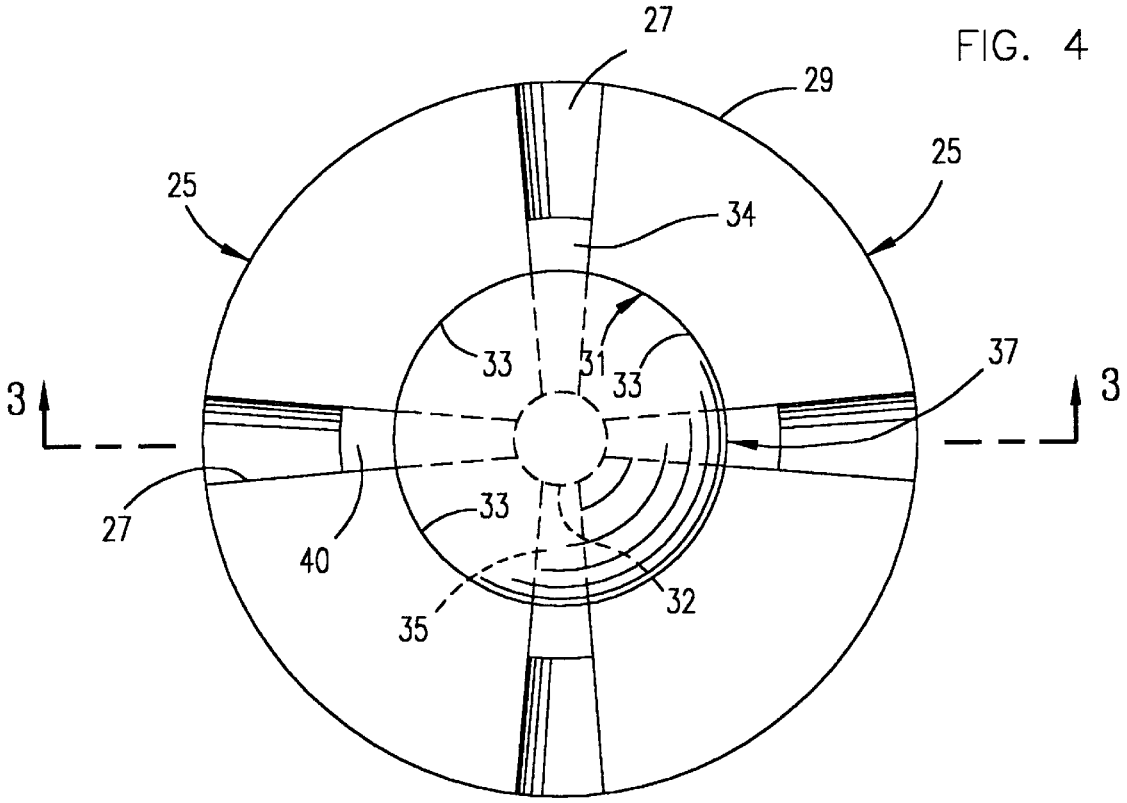
FIG. 4 is a bottom plan view of the air bubble generator of FIG. 3 and taken along line 4—4 of FIG. 3.

As shown in FIGS. 3 and 4, a stainless steel sphere 37 is disposed or received within the cylindrical recess 31 in the housing 25. The sphere 37 is press fitted into the cylindrical recess 31 to be held therein so it does not protrude beyond the bottom surface 28 of the housing 25.

It should be understood that the sphere 37 is preferably disposed above the bottom surface 28 of the housing 25. However, such is not necessary for operation.

The sphere 37 may be formed of any other suitable hydrophilic material such as glass, for example. The sphere 37 is formed of a hydrophilic material since it is desired for the sphere 37 to function as a capillary member. It should be understood that the sphere 37 could be replaced by other configurations such a cylinder, for example.

The sphere 37 is preferably concentrically disposed in the cylindrical recess 31 in the housing 25 although such is not necessary. An air bubble generator 38 includes the combination of the housing 25 and the sphere 37.

The air bubble generator 38 has an operative portion 39 formed in the annular space between the inner surface of the housing 25 and the exterior of the sphere 37. Particularly, the operative portion 39 of the air bubble generator 38 consists of a plurality of capillary channels 40, which extend from the scallops 27 in the bottom surface 28 of the housing 25 through the grooves 34 and 35 to the lower entrance of the passage 24 in the vertical surge tube 23. The plurality of the capillary channels 40 insures reliable, continuous communication between the interior of the sealed reservoir 11 (see FIG. 1) and the vertical surge tube 23, which is connected to ambient atmosphere through the inlet vent 16.

In the normal orientation of the ink cartridge 10, the housing 25 is submerged in ink 42 until the sealed reservoir 11 is nearly depleted of the ink 42. A quantity of the ink 42 forms an ink-air interface, which is commonly called a meniscus, in the capillary channels 40 (see FIG. 3).

Under normal operating conditions, the pressure of the ink 42 (see FIG. 1) in the sealed reservoir 11 is depressed relative to the ambient pressure. Because of its interfacial tension, the ink-air interface prevents the passage of air through the plurality of the capillary channels 40 (see FIG. 3) and into the sealed reservoir 11 (see FIG. 1). When a critical pressure difference is exceeded, an air bubble is pulled through the ink-air interface to relieve the back pressure. This insures that the pressure difference never exceeds the critical value.

During the lifetime of the ink cartridge 11, there occasionally occurs a reduction in ambient pressure. This might occur, for example, in an unpressurized compartment of an airplane. Such a reduction in ambient pressure necessarily reduces the pressure difference between the ink 42 inside the sealed reservoir 11 and the ambient air. The pressure difference must be re-balanced by the partial relaxation of an accumulator spring (not shown) and a corresponding collapse of the accumulator bags 21 and 22.

If the ambient pressure is decreased beyond a critical value which depends on the volume of the expended ink 42, the ink 42 will continue to leak from the sealed reservoir 11 through the capillary channels 40 (see FIG. 3) and into the passage 24 in the vertical surge tube 23.

If the reduction in ambient pressure is large enough, the ink 42 (see FIG. 1) continues to flow from the passage 24 in the vertical surge tube 23 into the horizontal passage 19 in the inlet vent 16 and ultimately into the interior of the accumulator bags 21 and 22. Therefore, the ink 42 does not escape from the ink cartridge 10; instead, it collects within the bags 21 and 22.

An increase in the back pressure within the sealed reservoir 11 also could occur if the bags 21 and 22 should fail to control the back pressure within the sealed reservoir 11 to its operating range.

Figure 2:
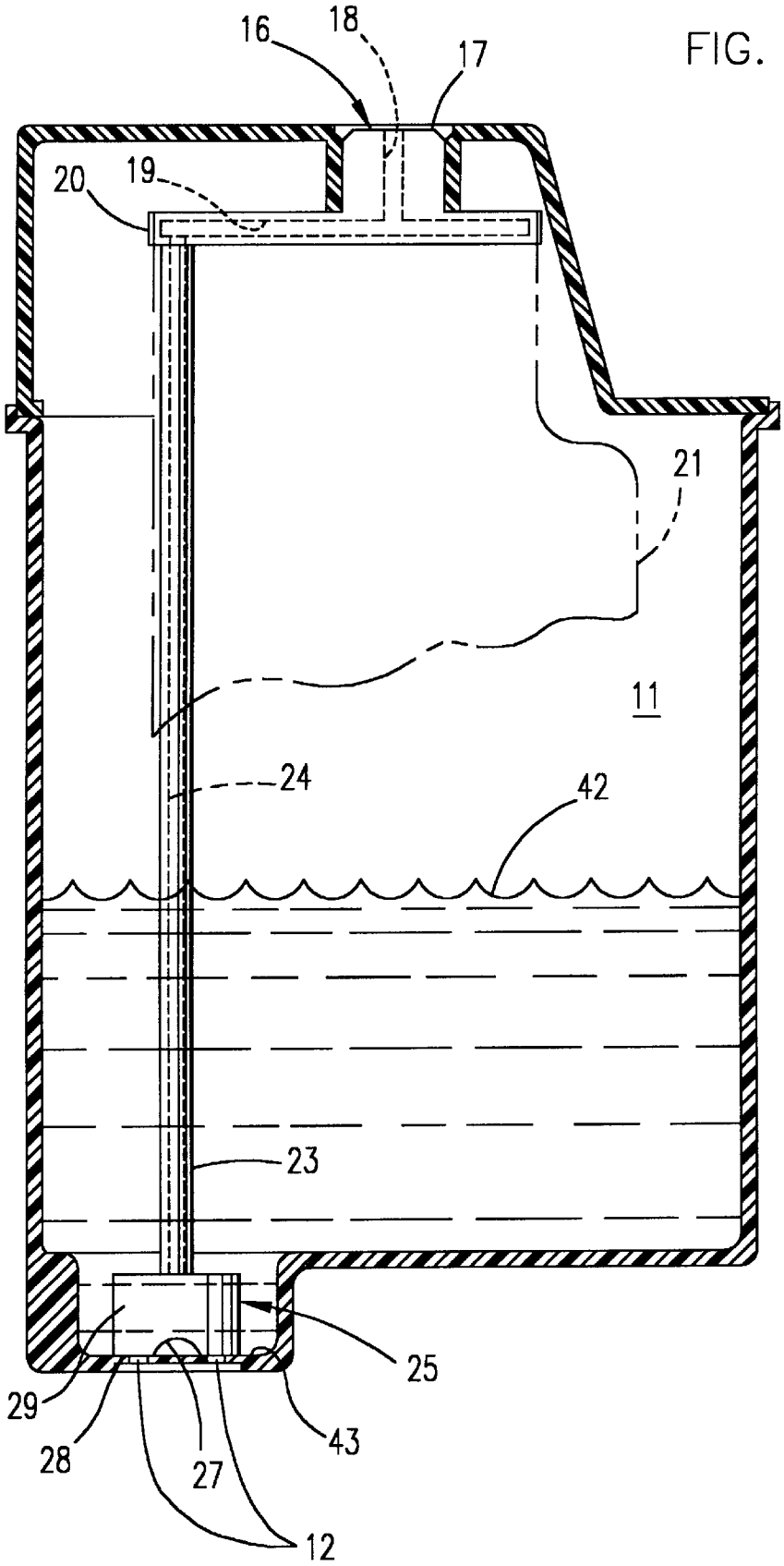
FIG. 2 is a side sectional view, partly in elevation, of a portion of the ink cartridge of FIG. 1 and taken along line 2—2 of FIG. 1.

As shown in FIG. 2, the bottom surface 28 of the housing 25 preferably rests on a bottom wall 43 of the sealed reservoir 11. It should be understood that the bottom surface 28 of the housing 25 may be spaced from the bottom wall 43 of the sealed reservoir 11, if desired.

The bottom wall 43 has the print head 12 fitted thereinto for ejecting ink drops from the sealed reservoir 11. The print head 12 is preferably a thermal-bubble type as described in the aforesaid Cowger et al patent.

Figure 5:
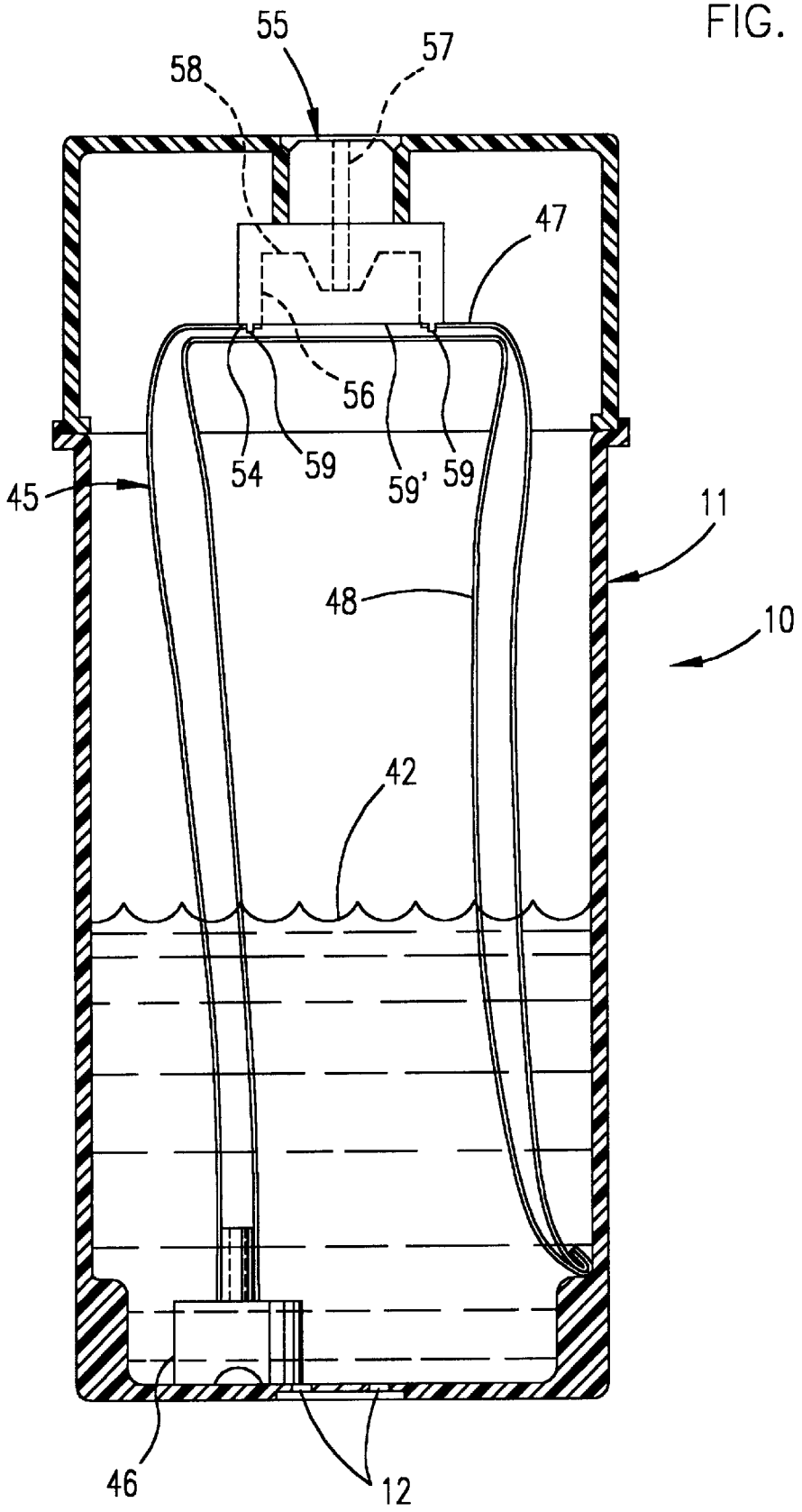
FIG. 5 is a front sectional view, partly in elevation, of another embodiment of an ink cartridge having the air bubble generator of the present invention connected to a bottom end of a bag used as part of an accumulator.

Referring to FIG. 5, there is shown another embodiment of the ink cartridge 10 in which the sealed reservoir 11 of the ink cartridge 10 has a single bag 45 in the manner more particularly shown and described in the aforesaid Cowger et al patent. The bag 45 has a housing 46 fixed to one end of the bag 45.

Figure 6:
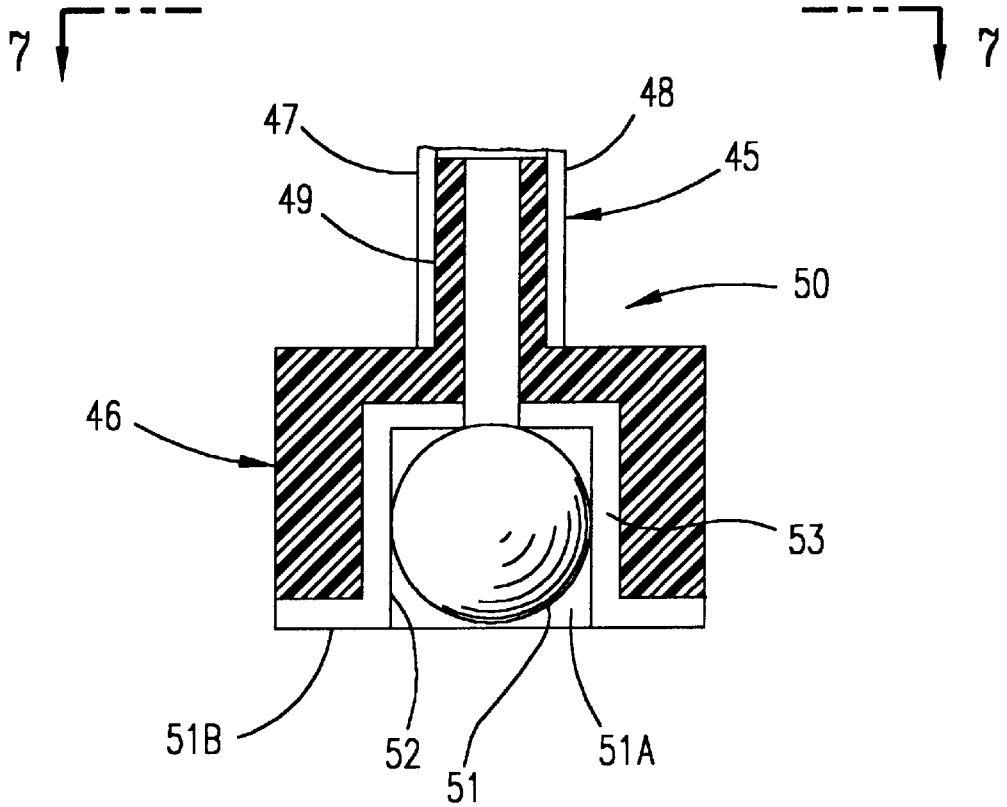
FIG. 6 is an enlarged fragmentary sectional view of a portion of the bag of FIG. 5 and its attachment to a housing having the air bubble generator and taken along line 6—6 of FIG. 7.

As shown in FIG. 6, the bag 45 has its opposite sides 47 and 48 at one of their ends adhered to an outer surface 49 of the housing 46 of an air bubble generator 50. The opposite sides 47 and 48 of the bag 45 are adhered to the outer surface 49, which is preferably non-circular, of the housing 46 of the air bubble generator 50 by a suitable thermal bond, for example.

Figure 7:
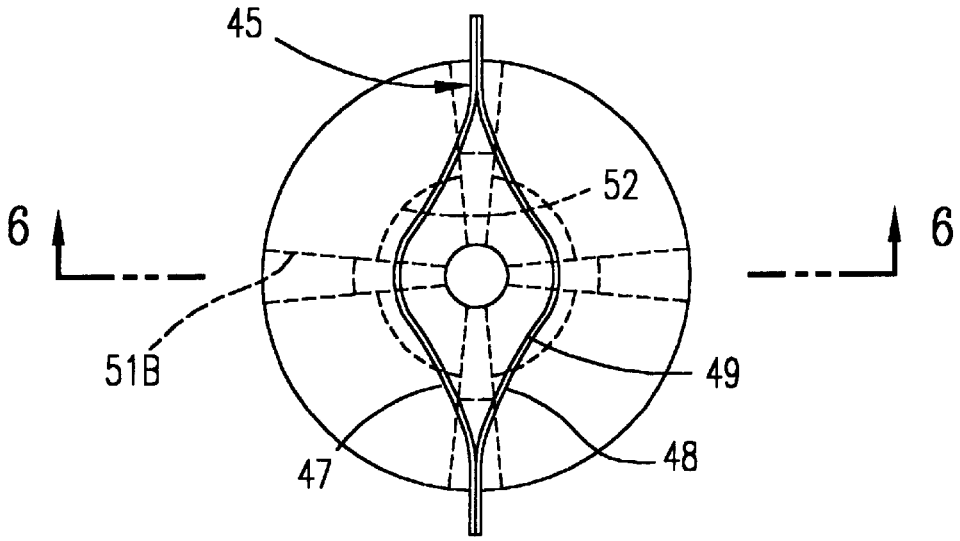
FIG. 7 is a top plan view of a portion of the bag of FIG. 5 sealed to the housing of the air bubble generator of FIG. 6 and taken along line 7—7 of FIG. 6 with the sphere omitted for clarity purposes.

An exemplary non-circular shape of the outer surface 49 of the housing 46 is shown in FIG. 7. The shape is chosen for ease of manufacturing in sealing the bag 45 to the outer surface 49 of the housing 46.

The air bubble generator 50 (see FIG. 6) also includes a sphere 51 in an enlarged recess 51A in a bottom surface 51B of the housing 46. The sphere 51 cooperates with ribs 52 (see FIG. 7) in the inner surface of the recess 51A (see FIG. 6) to form a plurality of capillary channels 53 of a fixed size in the same manner as described for the capillary channels 40 (see FIG. 4).

The bag 45 (see FIG. 5) is supported on a bottom surface 54 of an inlet vent 55. The inlet vent 55 includes a relatively large inlet vent manifold 56 into which the ink 42 can flow if the bag 45 becomes filled with the ink 42. While the bag 45 normally never becomes full with the ink 42, this is an added precaution.

The inlet vent 55 also includes a vertical passage 57 connecting the inlet vent manifold 56 with the ambient atmosphere surrounding the sealed reservoir 11. Thus, the interior of the bag 45 communicates with the ambient atmosphere.

The bag 45 is designed so that the housing 46 is within the ink 42 in the sealed reservoir 11. The air bubble generator 50 (see FIG. 6) operates in the same manner as previously described for the air bubble generator 38 (see FIG. 3). Accordingly, if the ink 42 (see FIG. 5) leaks from the sealed reservoir 11 through the capillary channels 53 (see FIG. 6) of the air bubble generator 50, the ink 42 (see FIG. 5) will flow to the interior of the bag 45. If the interior of the bag 45 becomes full, then the inlet vent manifold 56 will begin to collect the ink 42 therein.

Additionally, if the position of the cartridge 10 should be inverted from that shown in FIG. 5, the ink 42 would not flow from the inlet vent manifold 56 to the ambient atmosphere through the vertical passage 57 in the inlet vent 55 unless the quantity of the ink 42 in the inlet vent manifold 56 exceeds that from a top surface 58 of the inlet vent manifold 56 to where the vertical passage 57 communicates with the inlet vent manifold 56.

The bag 45 is supported on the bottom surface 54 of the inlet vent 55. Nipples 59, which extend from the bottom surface 54 of the inlet vent 55, pass through the side 47 of the bag 45 to form an attachment. Any other suitable attaching means may be employed. It is only necessary that the interior of the bag 45 be open to communicate with the inlet vent manifold 56 of the inlet vent 55 through forming the side 47 of the bag 45 with an opening 59' between the nipples 59.

Figure 8:
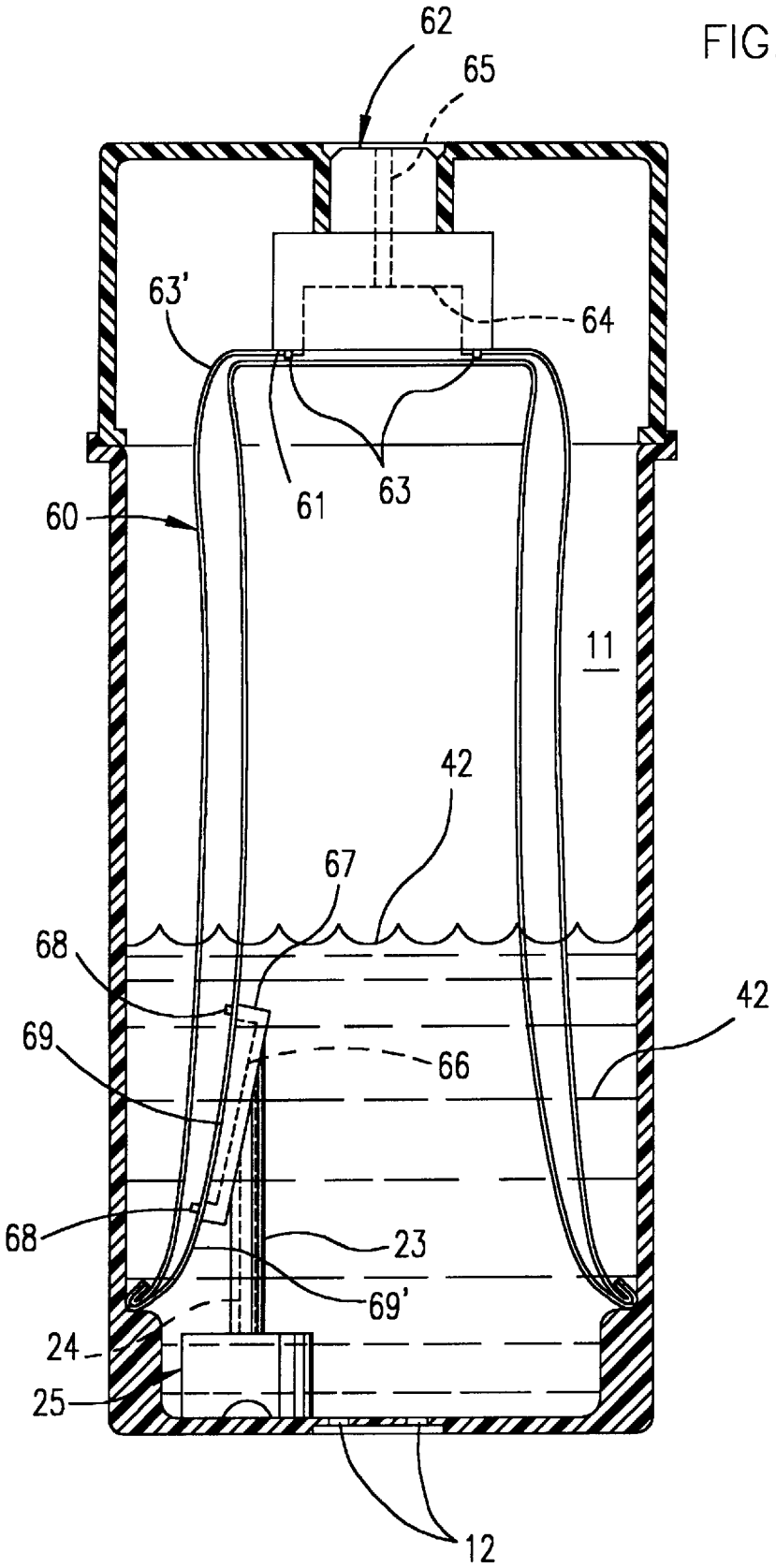
FIG. 8 is a side sectional view, partly in elevation, of another modification of an ink cartridge in which the air bubble generator is connected to the bottom end of the bag.

Referring to FIG. 8, there is shown a single bag 60 attached to a bottom surface 61 of an inlet vent 62. Nipples 63 extend from the bottom surface 61 to pass through the bag 60 to attach the bag 60 to the inlet vent 62.

The inlet vent 62 has a chamber 64 extending inwardly from the bottom surface 61 between the nipples 63. The chamber 64 communicates with the interior of the bag 60 between the nipples 63. The bag 60 has an opening in its side 63' adjacent the chamber 64.

The inlet vent 62 has a vertical passage 65 extending from the chamber 64 to the ambient atmosphere exterior of the sealed reservoir 11. Thus, air from the ambient atmosphere can flow through the vertical passage 65 and the chamber 64 into the interior of the single bag 60.

The vertical passage 24 in the tube 23, which extends upwardly from the housing 25 of the air bubble generator 38 (see FIG. 3), communicates with a chamber 66 (see FIG. 8) in a flange 67 on the upper end of the tube 23. Nipples 68 extend from a bottom surface 69 of the flange 67 to pass through a side 69' of the single bag 60 to attach the single bag 60 to the flange 67.

An opening is provided in the side 69' of the bag 60 between the nipples 68 to communicate the interior of the bag 60 with the chamber 66 in the flange 67. Thus, the ink 42 flows from the vertical passage 24 in the tube 23 to the flange 67 into the single bag 60 when there is leakage of the ink 42.

The ambient air pressure is communicated to the interior of the bag 60 through the vertical passage 65 and the chamber 64. From the interior of the bag 60, the air pressure is communicated to the air bubble generator 50 (see FIG. 6) and, upon demand, an air bubble is pulled through the capillary channels 53 of the air bubble generator 50 in the manner previously described. Likewise, the ink 42 (see FIG. 8) is conveyed through the capillary 53 (see FIG. 6) when the ink 42 (see FIG. 8) leaks from the sealed reservoir 11.

Figure 9:
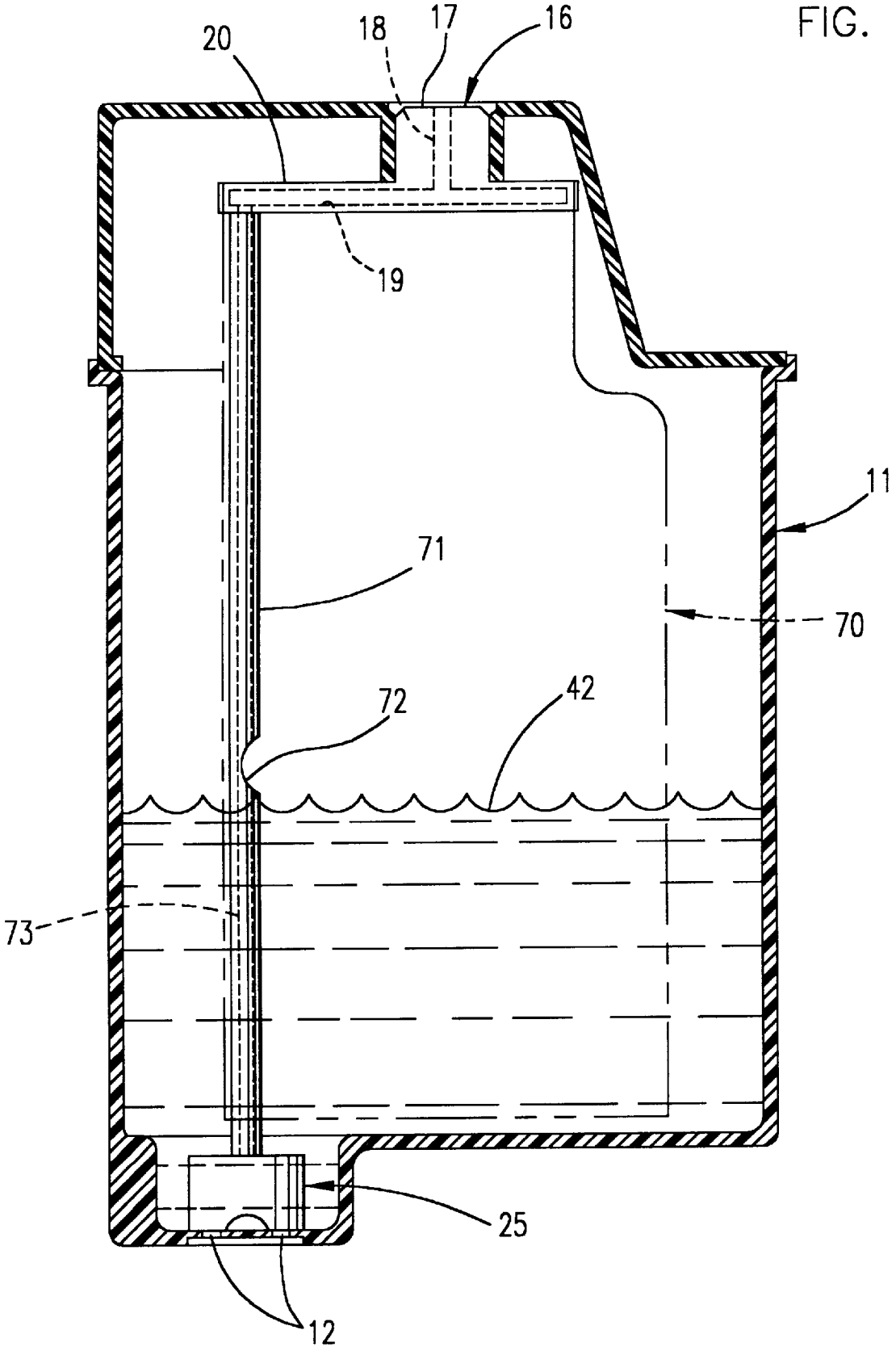
FIG. 9 is a side sectional view, partly in elevation, of another embodiment of an ink cartridge in which the air bubble generator communicates with the bag and the inlet vent.

Referring to FIG. 9, there is shown another embodiment of the present invention in which the sealed reservoir 11 has two bags (one shown at 70) therein in the same manner as the two bags 21 (see FIG. 1) and 22. A tube 71 from the housing 25 passes through the bag 70. The tube 71 replaces the tube 23 (see FIG. 1).

With the tube 71 (see FIG. 9) disposed within the bag 70, an opening 72 in the tube 71 provides communication of the interior of the bag 70 with a vertical passage 73 in the tube 71. As a result, if the ink 42 leaks from the sealed reservoir 11, the leaked ink 42 will flow into the interior of the single bag 70 through the opening 72 in the tube 71.

The tube 71 is connected at its upper end to the horizonal passage 19 in the horizontal bag support portion 20 of the inlet vent 16. Thus, air can enter the interior of the bag 70 through the vertical passage 18 in the vent portion 17 of the inlet vent 16 and the horizontal passage 19 in the horizontal bag support portion 20 of the inlet vent 16.

Figure 10:
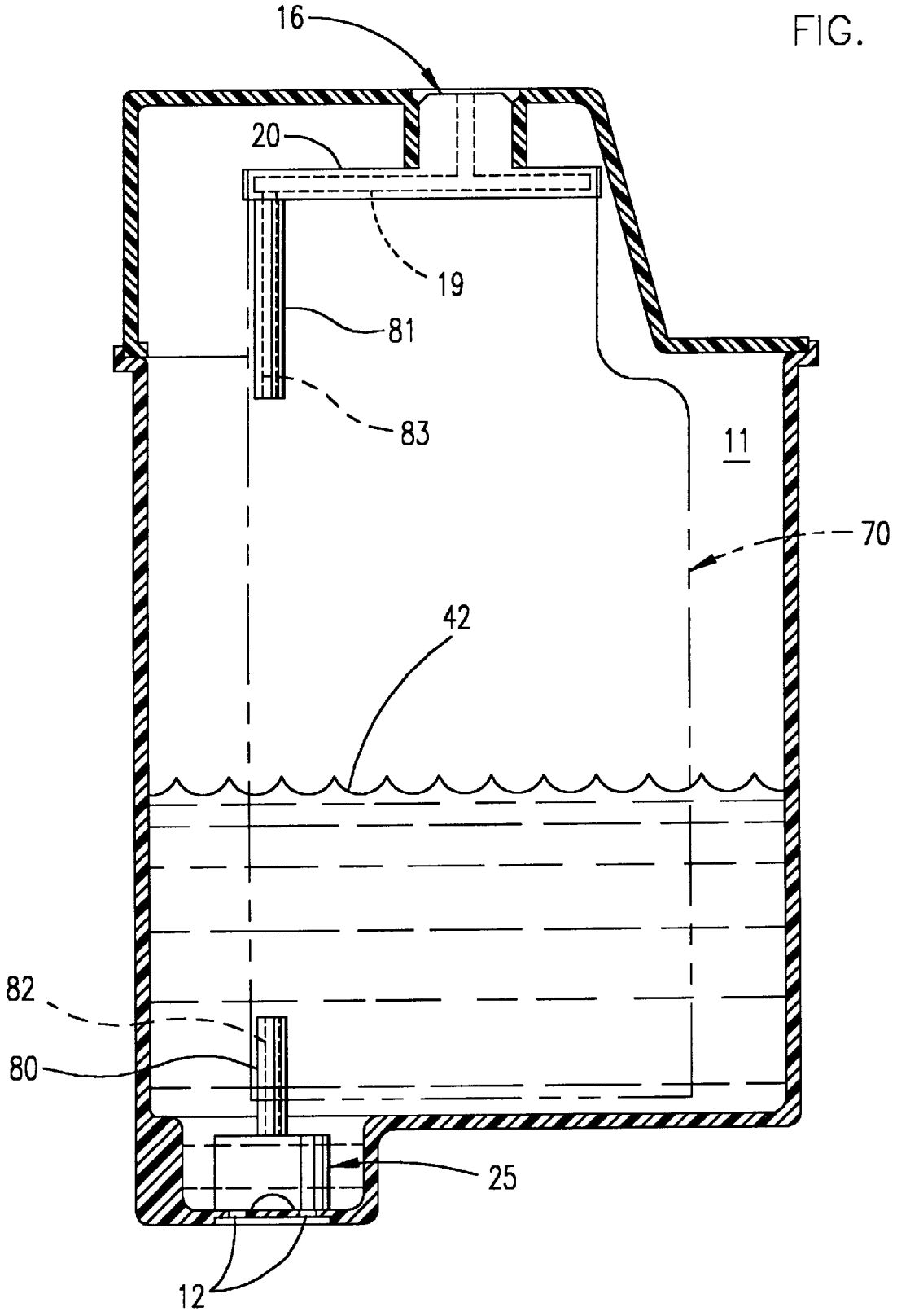
FIG. 10 is a side sectional view, partly in elevation, of still another embodiment of an ink cartridge in which the air bubble generator communicates with the inlet vent through the bag.

Referring to FIG. 10, there is shown a modification of FIG. 9 in which the tube 71 is replaced by a lower tube 80 (see FIG. 10) and an upper tube 81. The lower tube 80 has a vertical passage 82 communicating with the housing 25, and the upper tube 81 has a vertical passage 83 communicating with the horizontal passage 19 in the horizontal bag support portion 20 of the inlet vent 16.

However, the upper end of the vertical passage 82 in the tube 80 communicates with the interior of the bag 70 as does the lower end of the vertical passage 83 in the upper tube 81. Therefore, air from the ambient atmosphere surrounding the sealed reservoir 11 enters the interior of the bag 70 through the vertical passage 83 in the upper tube 81 and exits therefrom through the vertical passage 82 in the lower tube 80 to the housing 25. This enables the air bubbles to be supplied, when needed, to the interior of the sealed reservoir 11 through the air bubble generator 38 (see FIG. 3).

Whenever there is any leakage of the ink 42 (see FIG. 10), the ink 42 flows through the housing 25 and the vertical passage 82 in the lower tube 80 into the interior of the bag 70. Thus, the ink 42, which leaks from the sealed reservoir 11 through the capillary channels 40 (see FIG. 4), is retained within the interior of the bag 70 (see FIG. 10) so that it does not escape from the ink cartridge 10.

It should be understood that each of the bags 21 (see FIG. 1), 22, 45 (see FIG. 4), 60 (see FIG. 8), and 70 (see FIG. 9) is biased by a spring in the manner shown and described in the aforesaid Cowger et al patent, for example.

It should be understood that the air bubble generating means may be formed in any suitable manner other than using the sphere 37 (see FIG. 3), the sphere 51 (see FIG. 6), or the cylinder next to one or more grooves. It is only necessary that the geometry and material properties control the ink-air interface to allow a bubble to pass to the sealed reservoir 11 (see FIG. 1) at back pressures in excess of a designed critical value.

One means of achieving this required ink-air interface in an air bubble generator is to use a small piece of foam or felt through which air or ink may pass depending upon the pressure across the foam or felt.

Another means is to replace the sphere 37 (see FIG. 3) with a piece of properly sized wire mesh attached to the horizontal upper wall 36 with the horizontal grooves 35 omitted therefrom, for example. The mesh can be heat staked to the horizontal upper wall 36 (see FIG. 3) of the housing 25 to seal its outside periphery.

A further means for achieving this required ink-air interface in an air bubble generator is to seal a short tube or a hole in a plate with the proper inside diameter to the bottom of the bag.

An advantage of this invention is that it avoids ink leakage from a disposable ink cartridge for use in an ink jet printer. Another advantage of this invention is that it eliminates the requirement for an ink storage area as part of the air bubble generator. A further advantage of this invention is that only one opening to the ambient atmosphere is required.

For purposes of exemplification, preferred embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An ink cartridge for an ink jet printer including:

a sealed reservoir having an interior for containing ink;

an accumulator mounted within said sealed reservoir, said accumulator having an exterior exposed to the interior of said sealed reservoir;

said accumulator having an interior communicating with an ambient air exterior of said sealed reservoir so that said accumulator expands in response to a reduction of the ink within said sealed reservoir;

air bubble generating means communicating with said sealed reservoir and the ambient air exterior of said sealed reservoir for generating air bubbles into said sealed reservoir;

said air bubble generating means and said accumulator cooperating to maintain a back pressure within an operating range in said sealed reservoir;

and conveying means for conveying any ink leaking from said sealed reservoir through said air bubble generating means into the interior of said accumulator.

2. The ink cartridge according to claim 1 including a vent communicating the ambient air with the interior of said accumulator.

3. The ink cartridge according to claim 2 in which said vent communicates with said conveying means.

4. The ink cartridge according to claim 3 in which said sealed reservoir has a lowermost portion in which said air bubble generating means is disposed.

5. The ink cartridge according to claim 4 in which said air bubble generating means includes:

a sphere;

a fixed support having receiving means for receiving said sphere, said sphere being retained within said receiving means in said fixed support;

said sphere cooperating with said receiving means in said fixed support to define at least one capillary channel of a fixed size therebetween, said sphere being formed of a hydrophilic material;

said at least one capillary channel communicating said sealed reservoir and said conveying means with each other;

and said at least one capillary channel maintaining a quantity of the ink therein from said sealed reservoir to seal said at least one capillary channel when the back pressure in said sealed reservoir is within the operating range and allowing the ambient air to bubble through an ink-air interface within said at least one capillary channel when the back pressure exceeds the operating range to lower the back pressure in said sealed reservoir.

6. The ink cartridge according to claim 5 including communicating means for communicating said vent with said at least one capillary channel of said air bubble generating means through said conveying means.

7. The ink cartridge according to claim 6 in which said vent is a single vent disposed above said accumulator, said single vent also communicating with said conveying means.

8. The ink cartridge according to claim 7 in which:

said fixed support includes a housing having said receiving means communicating with said sealed reservoir, said housing resting in the lowermost portion of said sealed reservoir;

and said sphere is disposed within said receiving means in said housing and retained in said receiving means in said housing.

9. The ink cartridge according to claim 8 in which:

said sealed reservoir includes a support surface;

said housing has a bottom surface resting on said support surface of said sealed reservoir;

and means in said housing adjacent said bottom surface for allowing ambient air bubbles to flow through said receiving means in said housing and said at least one capillary channel into said sealed reservoir and the ink to flow from said sealed reservoir into the interior of said accumulator when the ink leaks from said sealed reservoir through said at least one capillary channel.

10. The ink cartridge according to claim 7 in which:

said conveying means includes a tube connected to said receiving means in said fixed support;

said tube extends through said accumulator to said vent;

and said tube has an opening within said accumulator to allow the ink to flow into the interior of said accumulator when the ink leaks from said sealed reservoir through said at least one capillary channel and the ambient air to flow into said tube from said accumulator to said sealed reservoir through said at least one capillary channel.

11. The ink cartridge according to claim 7 in which said conveying means includes a tube communicating said receiving means in said fixed support and the interior of said accumulator with each other to allow ambient air bubbles to flow through said receiving means in said fixed support into said sealed reservoir and the ink to flow from said sealed reservoir into the interior of said accumulator when the ink leaks from said sealed reservoir through said at least one capillary channel.

12. The ink cartridge according to claim 5 in which:

said fixed support includes a housing having said receiving means communicating with said sealed reservoir, said housing resting in the lowermost portion of said sealed reservoir;

said sealed reservoir includes a support surface;

said housing has a bottom surface resting on said support surface of said sealed reservoir; said sphere is disposed within said receiving means in said housing above said bottom surface of said housing;

and means in said housing adjacent said bottom surface for communicating said sealed reservoir with said at least one capillary channel.

13. The ink cartridge according to claim 2 in which:

said conveying means includes a tube connected to said air bubble generating means;

said tube extends through said accumulator to said vent;

and said tube has an opening within said accumulator to allow the ink to flow into the interior of said accumulator when the ink leaks from said sealed reservoir through said air bubble generating means and the ambient air to flow into said tube from said accumulator to said sealed reservoir through said air bubble generating means.

14. The ink cartridge according to claim 2 in which said conveying means includes a tube communicating said air bubble generating means and the interior of said accumulator with each other to allow ambient air bubbles to flow through said air bubble generating means into said sealed reservoir and the ink to flow from said sealed reservoir into the interior of said accumulator when the ink leaks from said sealed reservoir through said air bubble generating means.

15. The ink cartridge according to claim 2 in which said vent is a single vent disposed above said accumulator, said single vent communicating with said conveying means.

16. The ink cartridge according to claim 2 in which said air bubble generating means includes:

a sphere;

a fixed support having receiving means for receiving said sphere, said sphere being retained within said receiving means in said fixed support;

said sphere cooperating with said receiving means in said fixed support to define at least one capillary channel of a fixed size therebetween, said sphere being formed of a hydrophilic material;

said at least one capillary channel communicating said sealed reservoir and said conveying means with each other;

and said at least one capillary channel maintaining a quantity of the ink therein from said sealed reservoir to seal said at least one capillary channel when the back pressure in said sealed reservoir is within the operating range and allowing the ambient air to bubble through an ink-air interface within said at least one capillary channel when the back pressure exceeds the operating range to lower the back pressure in said sealed reservoir.

17. The ink cartridge according to claim 1 in which:

said conveying means includes a tube connected to said air bubble generating means;

said tube extends through said accumulator for communicating with the ambient air exterior of said sealed reservoir;

and said tube has an opening within said accumulator to allow the ink to flow into the interior of said accumulator when the ink leaks from said sealed reservoir through said air bubble generating means.

18. The ink cartridge according to claim 1 in which said conveying means includes a tube communicating said air bubble generating means and the interior of said accumulator to allow ambient air bubbles to flow through said air bubble generating means into said sealed reservoir and the ink to flow from said sealed reservoir into the interior of said accumulator when the ink leaks from said sealed reservoir through said air bubble generating means.

19. The ink cartridge according to claim 1 in which said air bubble generating means includes:

a sphere;

a fixed support having receiving means for receiving said sphere, said sphere being retained within said receiving means in said fixed support;

said sphere cooperating with said receiving means in said fixed support to define at least one capillary channel of a fixed size therebetween, said sphere being formed of a hydrophilic material;

said at least one capillary channel communicating said sealed reservoir and said conveying means with each other;

and said at least one capillary channel maintaining a quantity of the ink therein from said sealed reservoir to seal said at least one capillary channel when the back pressure in said sealed reservoir is within the operating range and allowing the ambient air to bubble through an ink-air interface within said at least one capillary channel when the back pressure exceeds the operating range to lower the back pressure in said sealed reservoir.

20. The ink cartridge according to claim 1 in which:

said accumulator includes at least one expandable and contractible bag mounted within said sealed reservoir and having an the exterior exposed to the back pressure within said sealed reservoir;

and said bag has an interior communicating with the ambient air exterior of said sealed reservoir so that said bag expands in response to a the reduction of the ink within said sealed reservoir.

21. An ink cartridge for an ink jet printer including:

a sealed reservoir having an interior for containing ink;

an accumulator mounted within said sealed reservoir, said accumulator having an exterior exposed to the interior of said sealed reservoir;

said accumulator having an interior communicating with ambient air exterior of said sealed reservoir so that said accumulator expands in response to a reduction of the ink within said sealed reservoir;

air bubble generating means communicating with said sealed reservoir and the ambient air exterior of said sealed reservoir for generating air bubbles into said sealed reservoir when the back pressure within said sealed reservoir exceeds the operating range;

said air bubble generating means and said accumulator cooperating to maintain a back pressure within an operating range in said sealed reservoir;

said air bubble generating means including a fixed support;

said fixed support having a portion having a passage therein;

said portion of said fixed support having at least one capillary channel therein and communicating with said passage;

and said accumulator having a portion sealed to said portion of said fixed support to provide communication between the interior of said accumulator and said at least one capillary channel through said passage in said fixed support so that any of the ink leaking through said at least one capillary channel flows into the interior of said accumulator through said passage in said fixed support.

* * * * *